US005193920A

United States Patent [19]

Matsumoto et al.

[11] Patent Number: 5,193,920

[45] Date of Patent: Mar. 16, 1993

[54] DOT LINE PRINTER WITH PAPER FEED TIME CONTROLLING CAPABILITY

[75] Inventors: Yoshikane Matsumoto; Toshio Hiki; Toshiaki Fujieda; Shingo Nakahara; Shozo Ishii; Hiroto Inagawa, all of Katsuta, Japan

[73] Assignee: Hitachi Koki Co., Ltd., Tokyo, Japan

[21] Appl. No.: 562,534

[22] Filed: Aug. 3, 1990

[30] Foreign Application Priority Data

Aug. 4, 1989 [JP] Japan ..... 1-203046
Feb. 16, 1990 [JP] Japan ..... 2-36902

[51] Int. Cl.[5] ..... B41J 19/76

[52] U.S. Cl. ..... 400/121; 400/322; 400/328; 400/568; 101/93.04

[58] Field of Search ..... 400/322, 323, 328, 121, 400/568; 101/93.04, 93.05, 93.09

[56] References Cited

U.S. PATENT DOCUMENTS 4,761,085 8/1988 Angst et al. ..... 400/323
4,819,556 4/1989 Abe et al. ..... 400/121
4,889,052 12/1989 Matsumoto et al. ..... 101/93.04

FOREIGN PATENT DOCUMENTS 0267125 5/1988 European Pat. Off. ..... 101/93.04
108182 9/1983 Japan .
15170 6/1985 Japan .
258915 7/1989 Japan .

*Primary Examiner*—Edgar S. Burr
*Assistant Examiner*—John S. Hilten
*Attorney, Agent, or Firm*—Sughrue, Mion, Zinn, Macpeak & Seas

[57] ABSTRACT

A dot line printer with a paper feed time controlling capability includes a hammer bank accommodating a plurality of print hammers, a shuttle mechanism for shuttling the hammer bank back and forth along a print line, and a sheet feeding mechanism for feeding a sheet of paper in a direction perpendicular to the direction in which the hammer bank shuttles. When a first predetermined amount of a line space feeding is to be carried out after completion of one line printing, a hammer bank reversing time is prolonged. When more than the first predetermined amount of the line space feeding but less than a second predetermined amount of line space feeding is to be carried out, it is carried out during an extended period of time including both the hammer bank reversing time and the subsequent hammer bank scanning time without prolonging the hammer bank reversing time. Further, when the amount of the interline space feed is more than the second predetermined amount, it is taken place during a prolonged hammer bank reversing time and also the subsequent hammer bank scanning time.

5 Claims, 4 Drawing Sheets

DOT LINE PRINTER WITH PAPER FEED TIME CONTROLLING CAPABILITY

BACKGROUND OF THE INVENTION

The present invention relates generally to a dot line printer. More particularly, the invention relates to an improvement of a dot line printer disclosed in U.S. Pat. No. 4,889,052 assigned to the same assignee.

A conventional dot line printer has an arrangement as shown in FIGS. 1 and 2.

A hammer bank 8 is movably disposed along a line extending in a direction transverse to a sheet of paper 9. The hammer bank 8 accommodates a plurality of print hammers 16. Each print hammer 16 is in the form of an elongated leaf spring having an upper end to which a dot pin is attached and a lower end secured to a mounting plate by means of, for example, screws. The print hammers 16 are arranged in spaced apart relation to one another in the direction in which the hammer bank 8 moves. Although not shown, a print hammer driver is provided in association with each print hammer 16, which includes a permanent magnet, a yoke and a release coil. The hammer 16 is attracted to the face of the yoke pole by the permanent magnet and is released therefrom in response to the energization of the release coil, whereby the dot pin strikes the paper through an ink ribbon 20 to thus make an impression of a dot on the paper 9.

The hammer bank 8 is moved by a shuttle mechanism including a shuttle motor 1. Specifically, an eccentric cam 2 is attached to the shaft of the shuttle motor 1. Two cam followers 5 having the same outer contours are rotatably supported at the tip ends of the arms of a U-shaped shift plate 4 and are in contact with the cam surface. The shift plate 4 is fixedly secured to a shift shaft 3 which in turn is slidably movably supported by a frame 7 through bearings 6. The shift shaft 3 is secured to one side face of the hammer bank 8 and a bank shaft 17 is secured to another side face thereof. The bank shaft 17 is slidably movably supported by a holder 18 through a bearing 19.

The print paper 9 is provided with uniformly-spaced perforations which are drivingly engaged by pin feed tractors 15 to move the paper 9 incrementally past the hammer bank 8 in a direction perpendicular to the direction in which the hammer bank 8 moves. The tractors 15 are driven by a paper feed motor 10. Rotations of the motor 10 are transmitted to the tractors 15 via pulleys 11, 13 on which a belt 12 is mounted, and a shaft 14.

When the shuttle motor 1 is energized, the hammer bank 8 shuttles back and forth along a print line. During the rightward movement of the hammer bank 8, the print hammers 16 are selectively fired, thereby making dot impressions on the paper 9. The hammer bank 8 reaches the rightmost position and turns around thereat. At this time, the paper feed motor 10 is energized to advance the paper 9. The hammer bank 8 then moves leftwardly and the print hammers 16 makes another dot impressions on the paper 9. In this manner, one line made up of plural dot lines is printed by repeatedly carrying out such alternate print and paper feed cycles.

U.S. Pat. No. 4,889,052 proposes a dot line printer with an increased printing speed wherein 6 dot lines are printed at a time during one print cycle and a line space feeding is accomplished during the reversing time of the hammer bank 8 at the leftmost or rightmost position. As such, the proposed dot line printer is capable of printing more than 300 lines of Kanji character strings per one minute.

However, the proposed dot line printer is still unsatisfactory. In the case where one print line is composed of 30 dot lines in which 24 dot lines are allocated to print positions, the hammer bank 8 needs to shuttle twice or to perform four scans to print one print line. Assuming that the hammer bank 8 starts moving from the leftmost position, six dot lines (1st to 6th dot lines) are simultaneously printed with the first scan from left to right. When the hammer bank 8 turns around at the rightmost position, the paper 9 is advanced 6 dot lines. During the second scan of the hammer bank 8 moving from right to left, the subsequent 6 dot lines from 7th to 12th dot lines are printed. When the hammer bank 8 turns around at the leftmost position, the paper 9 is advanced another 6 dot lines. Similarly, during the third scan of the hammer bank 8 moving from left to right, the 13th to 18th dot lines are simultaneously printed and the paper 9 is advanced further 6 dot lines. In the fourth scan of the hammer bank 8 moving from right to left, the 19th to 24th dot lines are printed. After the fourth scan, the paper 9 is advanced 12 dot lines in the reversing duration of the hammer bank 8 at the leftmost position. Thus, a line spacing between the present and the subsequent print lines is preserved and the subsequent print line is allowed to be printed thereafter.

In the above-described printing sequence, the paper feed amount in the first to third reversing durations is lesser than that in the fourth reversing duration, although the hammer bank reversing duration is the same. If a paper feed time is set to meet a lesser amount of paper feed, subsequent line printing starts before the feeding of the paper 9 is completed, with the result that the printing quality is degraded. On the other hand, if the paper feed time is set to meet a larger amount of paper feed, the printing quality is not degraded. However, subsequent line printing does not immediately take place despite the fact that the line space feed has already terminated. This delay causes degradation to the printing speed.

As an improvement of the above-described dot line printer, it has been proposed that the hammer bank reversing duration be shortened only when the hammer bank turns around at the leftmost position. This proposal is made in view of the fact that the line space feeding is always performed when the hammer bank 8 turns around at the leftmost position. Accordingly, the printing speed can be increased somewhat.

However, the second proposal is still not ideal in that 12 dot lines of feeding time is given to the secondly performed hammer bank reversing for effecting 6 dot lines of feeding. Moreover, when printing is carried out while skipping some of the lines, it takes a long time to feed the paper for the skipped lines. The paper feeding will not be completed before the hammer bank 8 performs the subsequent scan. If the subsequent line printing were initiated from the rightward scan of the hammer bank 8, the subsequent line space feeding would be performed in the rightmost position in which the reversing duration of the hammer bank 8 is set shorter. In actuality, however, the line space feeding cannot be performed at the rightmost position, and so the printing cannot be started until the hammer bank 8 turns around at the leftmost position. Consequently, this unnecessary movement of the hammer bank results in lowering the printing speed. As described, when skipping of more than 2 lines after printing one line, unnecessary movement of the hammer bank is to be performed, and as a result, the printing speed would be excessively lowered.

SUMMARY OF THE INVENTION

The present invention has been made to solve the above-mentioned problems, and accordingly it is an object of the invention to provide a dot line printer which can carry out printing at a higher speed without causing degradation to the print quality.

In accordance with the present invention, when a first predetermined amount of a line space feeding is to be carried out after completion of one line printing, the hammer bank reversing time is prolonged. When more than the first predetermined amount of the line space feeding but less than a second predetermined amount of line space feeding is to be carried out, it is carried out during an extended period of time including both the hammer bank reversing time and the subsequent hammer bank scanning time without prolonging the hammer bank reversing time. Further, when the amount of the line space feed is more than the second predetermined amount, it is carried out during a prolonged hammer bank reversing time and also the subsequent hammer bank scanning time.

To achieve the above and other objects, according to a first embodiment of the present invention there is provided a dot line printer for carrying out printing on a sheet of paper upon making dot impressions thereon, having, a hammer bank movably disposed along a line extending in a first direction and accommodating a plurality of print hammers divided into M groups, each group containing N-number print hammers spacedly arranged in the first direction and displaced one dot line from one another in a second direction perpendicular to the first direction, wherein M and N are integers. A shuttle mechanism including at least a motor for shuttling the hammer bank back and forth along the line, the hammer bank turning around at first and second positions as the hammer bank shuttles, wherein N-dot lines are printed at a time during one print cycle of the hammer bank defined by a single movement of the hammer bank toward the first or second position after turning around at the second or the first position, respectively. A sheet feeding mechanism is provided for feeding the sheet of paper in the second direction during a hammer bank reversing time at which the hammer bank turns around at the first or second position. The sheet feeding mechanism feeds the sheet of paper N-dot lines when the print cycle follows immediately thereafter. A control means is provided for controlling the shuttle mechanism to prolong the hammer bank reversing time allowing the sheet feed mechanism to perform a first predetermined amount of line space feeding within the prolonged hammer bank reversing time when one line printing is finished upon carrying out a predetermined number of print cycles.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

The following description will be made under the following assumption. The print hammers are divided into groups, each including six print hammers wherein the dot pin positions of the six hammers are displaced one dot line from one another in the sheet feeding direction so that six dot lines can be printed simultaneously with a single scan of the hammer bank. One print line is made up of 30 dot lines in which 24 dot lines are allocated to character printing positions and the rest of 6 dot lines to line spacing between the two consecutive print lines. The hammer bank reversing time is set to 8 milliseconds. That is, it takes 8 milliseconds to feed the paper 6 dot lines.

Figure 1:
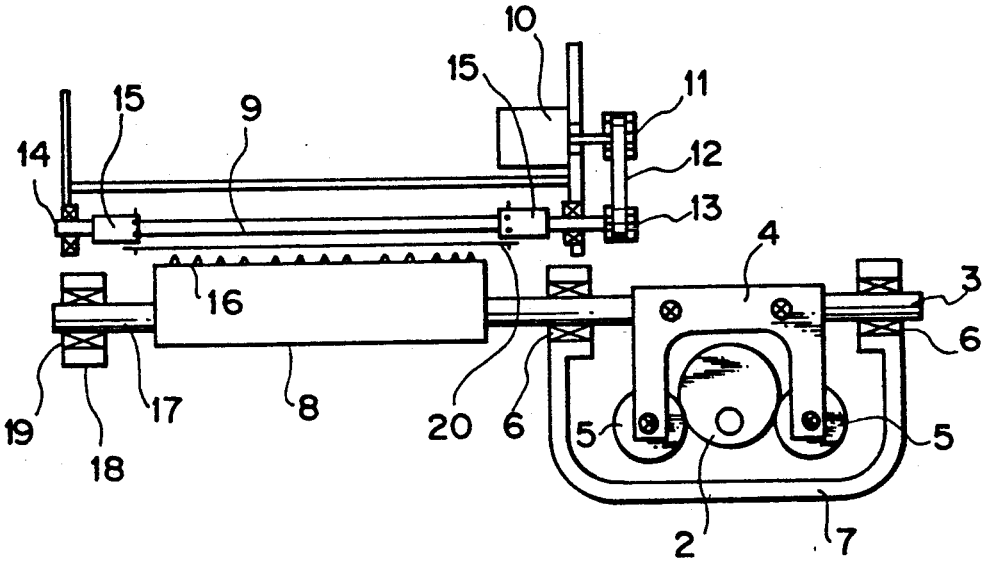
FIG. 1 PRIOR ART
FIG. 1 is a plan view showing an arrangement of a dot line printer.
Figure 2:
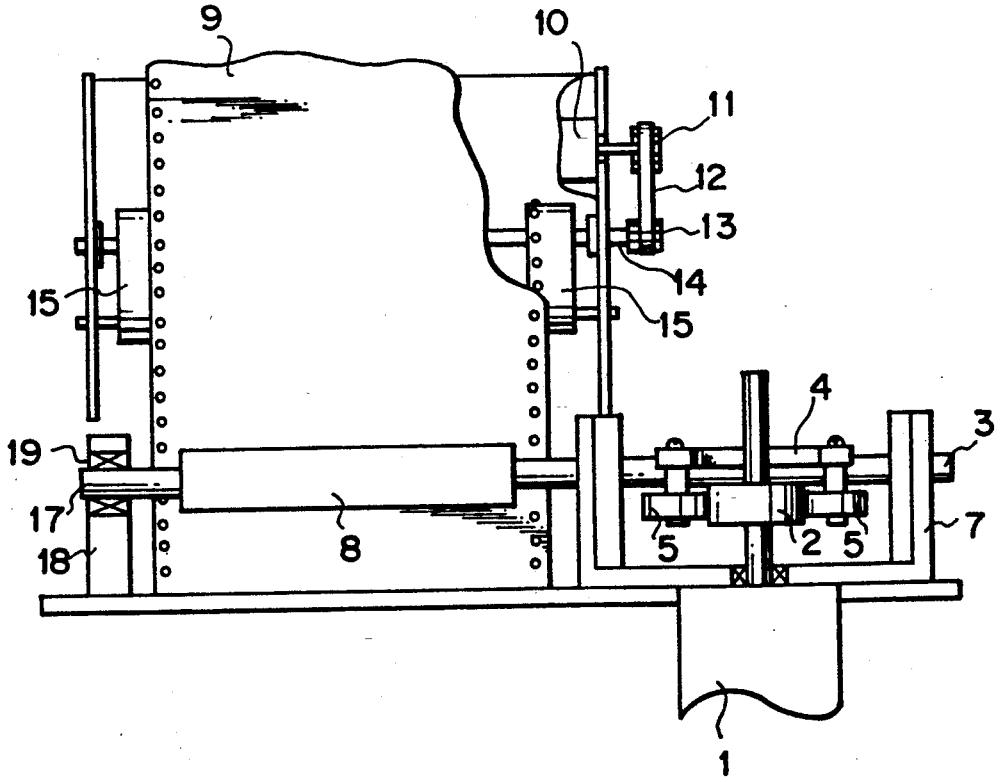
FIG. 2 PRIOR ART
FIG. 2 is a side elevational view showing the arrangement of the dot line printer.
Figure 3:
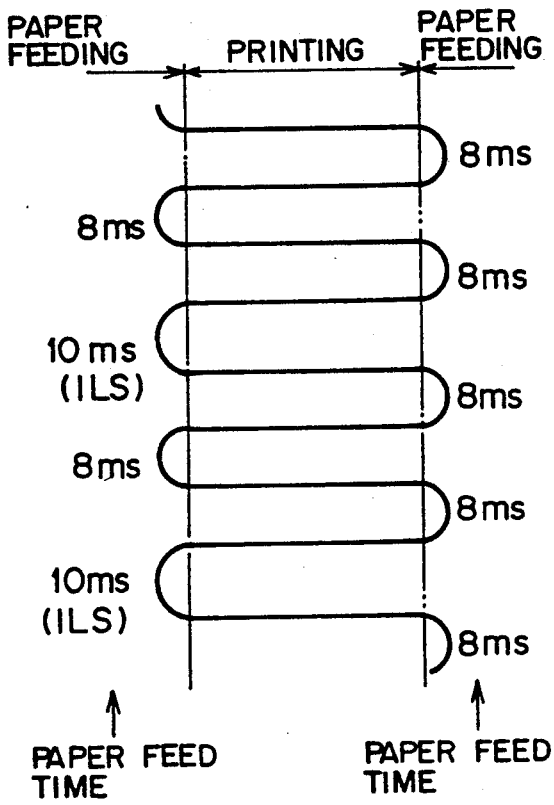
FIG. 3 is an explanatory diagram illustrating a moving locus of a hammer bank according to one embodiment of the present invention.
Figure 4:
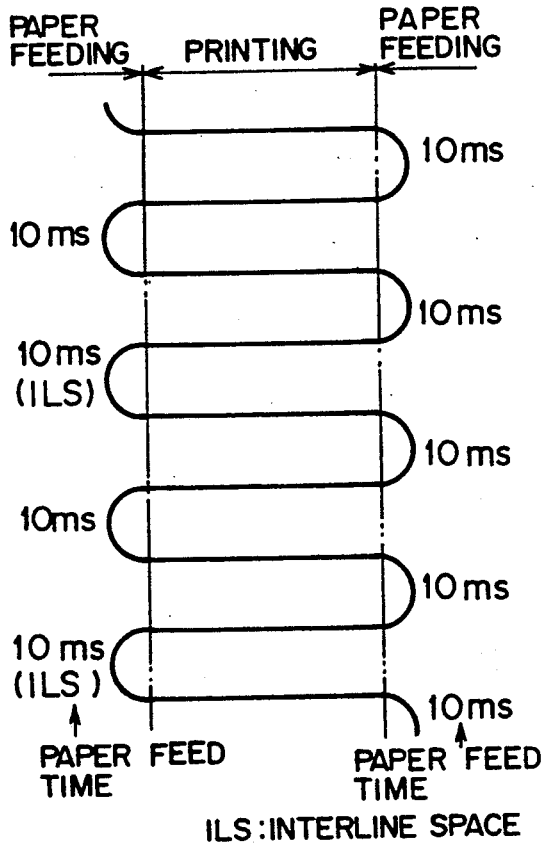
FIG. 4 PRIOR ART
FIG. 4 is an explanatory diagram illustrating a moving locus of a hammer bank according to a conventional dot line printer.

FIG. 3 illustrates a hammer bank locus relative to the print paper wherein reversal movement of the hammer bank is normally carried out at 8 milliseconds and the reversal movement wherein the line space feeding is to be performed is carried out at 10 milliseconds. FIG. 4 illustrates a hammer bank locus according to the printer of U.S. Pat. No. 4,889,052 wherein the hammer reversal time is 10 milliseconds regardless of whether or not the line space feeding is carried out.

Now assuming that in the case of FIG. 4, 330 lines are printed per one minute, a one line printing time is 181.82 milliseconds (60/330) whereat the paper feeding time occupies 40 milliseconds (10 ms$\times$4). On the other hand, according to the embodiment of the present invention, one line printing time is 175.82 milliseconds (181.82$-$6) and the total paper feeding time is 34 milliseconds (8$\times$3$+$10). Consequently, about 341 lines can be printed per one minute. That is, the number of print lines that can be printed per a unit time is increased by about 3.3% in comparison with that of the conventional dot line printer.

In order to set the reversing time to 10 milliseconds, a braking current is flowed in the shuttle motor 1 to thereby decelerate the rotational speed thereof. At the time immediately before the reversing time is expired, an acceleration current is flowed in the shuttle motor 1 to accelerate the rotational speed thereof so that the subsequent scan by the hammer bank is performed regularly. Such acceleration/deceleration control of the shuttle motor 1 is disclosed in the copending U.S. application Ser. No. 07/478,854 filed Feb. 12, 1990 assigned to the same assignee.

Figure 5:
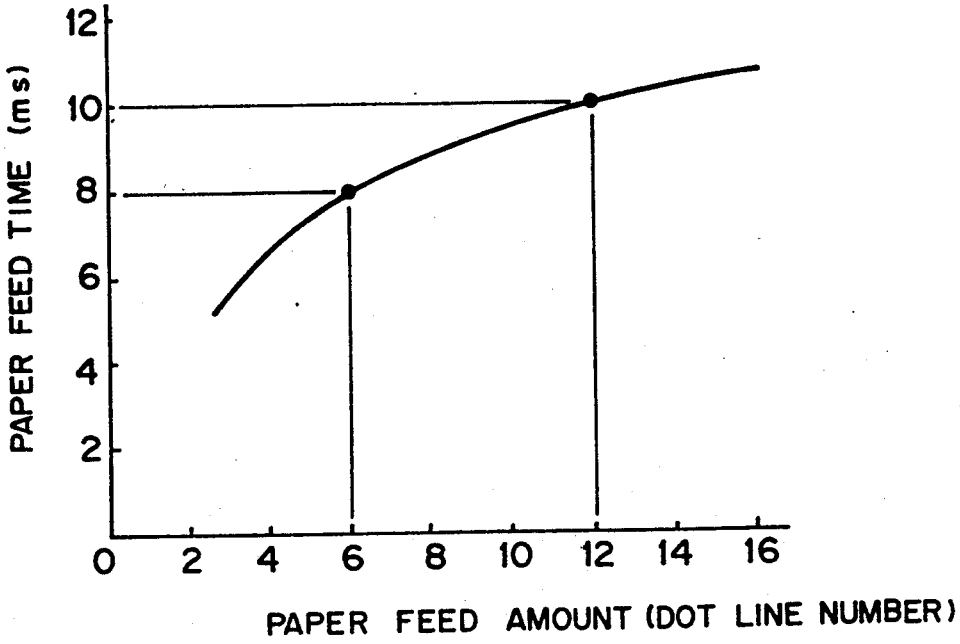
FIG. 5 is a graphical representation showing a relation between a paper feed time and a dot line number.

A relation between paper feed amount in terms of dot line numbers and paper feed time is such as shown in FIG. 5. Based on such a relation, the line space feeding time is set to 10 milliseconds in this embodiment. However, this specific time is not always applicable, since the curve depicted in FIG. 5 changes depending upon performances of the shuttle motor 1, tractor 15 or the like.

Figure 6:
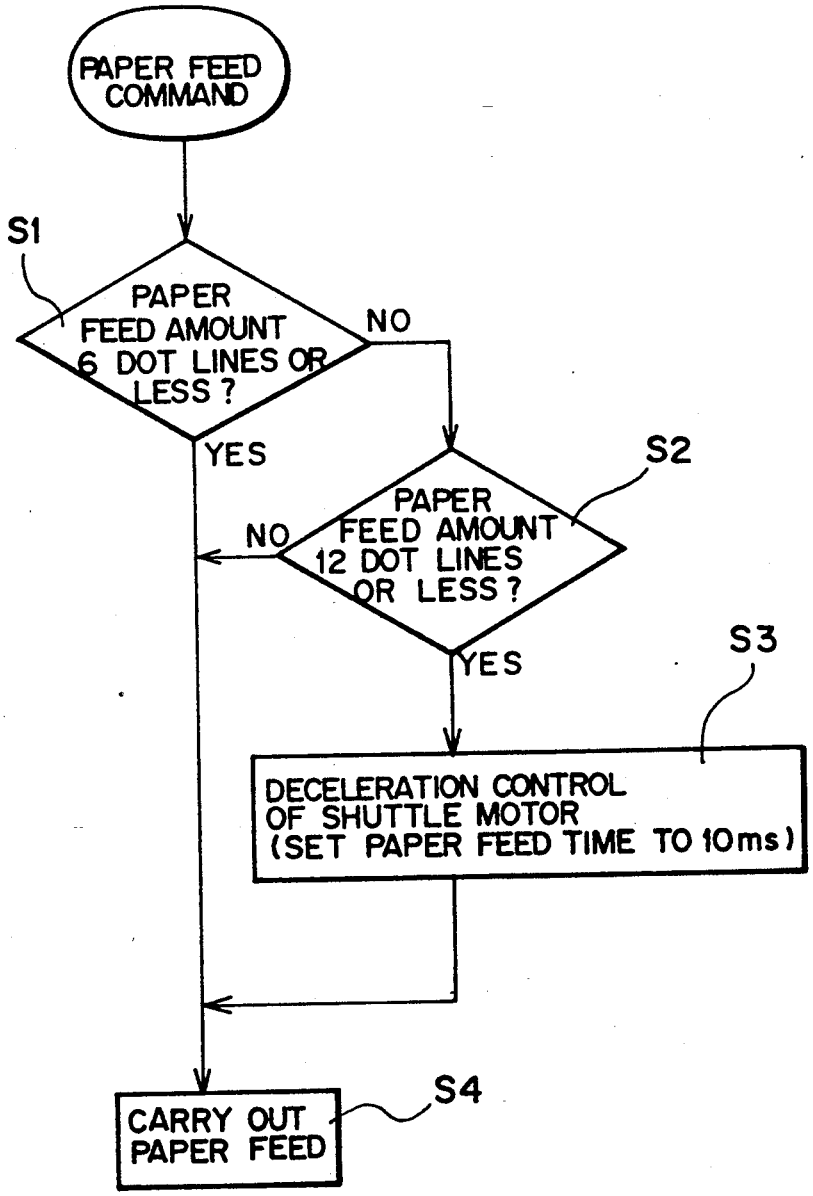
FIG. 6 is a flow chart, for description of a paper feed control according to a first embodiment of the present invention.

FIG. 6 is a flow chart describing of the paper feeding sequence. When a paper feed command is issued, it is checked, in step 1, whether 6 dot lines or less of paper feed is instructed. If YES, the paper feeding is performed by driving the paper feed motor 10 (step 4). If the decision made in step 1 is NO, the routine proceeds to step 2 where it is checked whether 12 dot lines or less of paper feed is instructed. If the decision made in step 2 is NO, the routine proceeds to step 4 where the paper feeding is performed as described. If the decision in step 2 is YES, the process in step 3 is implemented wherein a braking force is imparted to the shuttle motor 1 to prolong the reversing time. And, during the reversing period of time as set, the paper feeding is carried out in step 4.

In the above-described first embodiment, the hammer bank is moved back and forth by means of the shuttle motor 1 and the cams 2. As disclosed in U.S. Pat. No. 4,180,766 or Japanese Patent Publication (Kokoku) No. 62-61434, the hammer bank 8 may be moved by a combination of a linear motor and a resilient repulsive member such as a leaf spring. In this instance, an input current flowed to the linear motor is interrupted during the hammer bank reversing time. In order to prolong the reversing time to reserve the line spacing, an input current may be flowed to the linear motor so that the linear motor generates a propulsion force in a direction opposite to the hammer bank's reversed direction. By controlling both the level and duration of the input current applied thereto, the reversing time can be appropriately controlled.

In the above embodiment, in the case where a multiplicity of line space feedings are to be carried out, the hammer bank reversing time is not extended but the paper feeding is carried out in the course of the subsequent scanning period of the hammer bank 8. However, if the paper feeding is performed in such a way, there may be a situation where an idle scan of the hammer bank taken place depending upon the number of the line space feedings.

More specifically, if one line printing time is 175.82 milliseconds, the printable time in a single scan of the hammer bank is about 35.5 milliseconds. A total paper feeding time at both the rightmost position and the subsequent leftmost position is 16 milliseconds (8 ms$\times$2). Therefore, it takes about 51.5 milliseconds in total for the hammer bank 8 to move one scan including leading paper feeding time at the leftmost position and the trailing paper feeding time at the rightmost position. Assuming that the paper is advanced 152 dot lines within 51.2 milliseconds (note that the relation between the paper feed time and the paper feed amount shown in FIG. 5 is no longer available, since the paper feed is performed at a higher speed as the paper feed amount increases), the four line paper feeding ($4\times30+12=132$ dot lines) is assured. However, if five line paper feeding ($5\times30+12$ dot lines) is intended to be performed, the paper feeding for this amount cannot be completed within 51.5 milliseconds. As a result, the hammer bank 8 starts moving before the five line paper feeding is ended.

Figure 7:
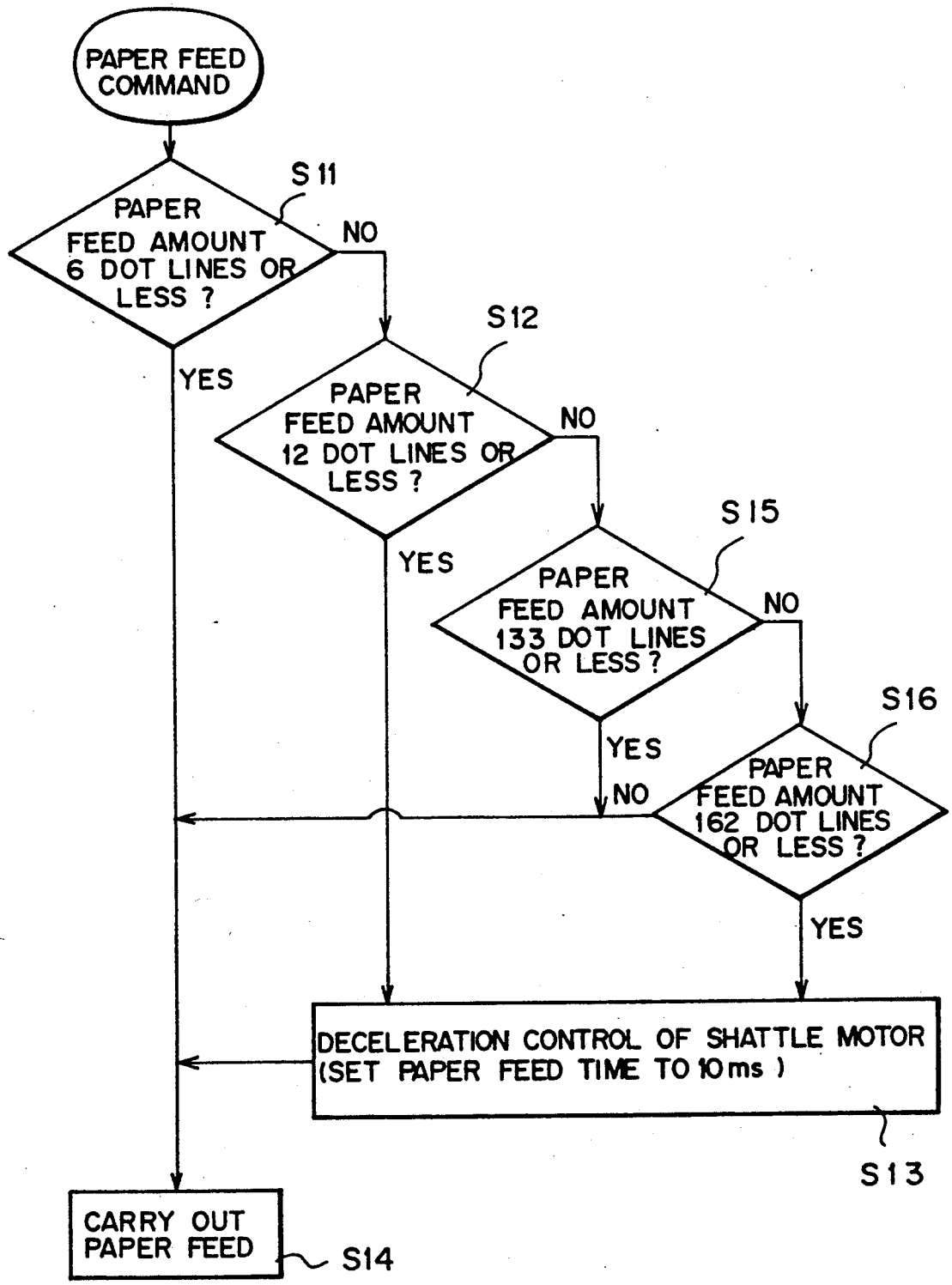
FIG. 7 is a flow chart for description of a paper feed control according to a second embodiment of the present invention.

To obviate the above-described problem, the paper feeding operation may be performed according to a second embodiment as illustrated in the flow chart of FIG. 7. The processings in steps S11, S12, S13 and S14 are similar to steps 1, 2, 3 and S4 in the flow chart of FIG. 6, respectively. In the flow chart of FIG. 7, it is checked, in step 15, whether the paper feeding for 4 lines or less is instructed. If the decision made in step 15 is YES, the routine advances to step 14 where the paper feeding is carried out. If the decision made in step 15 indicates that the paper feed amount as instructed exceeds 4 lines, the routine advances to step 16 where it checks whether the paper feeding for five lines or less is instructed. If YES, the processing in step 13 is implemented. That is, the shuttle motor 1 is imparted with a braking force to prolong the reversing time (step 13) and at the same time the paper feeding is carried out (step 14). As a result, the paper feeding time is extended to 55.5 milliseconds (51.5+4), so that the paper feeding for 5 lines can be achieved and idle scans of the hammer bank which may otherwise be caused can be obviated.

As described, according to the present invention, the hammer bank reversing time at when a line space feeding is not carried out can be shortened, and thus a high speed printing can be accomplished. Further, by appropriately adjusting the hammer bank reversing time, the paper can be placed stationary when the subsequent printing is started. Therefore, the printing quality can be improved. Moreover, the present invention can be readily applicable to the existing printers by simply altering a control circuit of the shuttle motor.

What is claimed is:

1. A dot line printer for carrying out printing on a sheet of paper upon making dot impressions thereon, comprising:

a hammer bank movably disposed along a line extending in a first direction and accommodating a plurality of print hammers divided into M groups, each groups containing N-number print hammers spacedly arranged in the first direction and displaced one dot line from one another in a second direction perpendicular to the first direction, wherein M and N are integers;

a shuttle mechanism including a rotary motor and a cam mechanism for shutting said hammer bank back and forth, at a first speed, along the line upon converting rotary motions of said motor to linear motions by means of said cam mechanism, said hammer bank reversing direction at first and second positions as said hammer bank shuttles, wherein N-dot lines are printed at a time during one print cycle of said hammer bank defined by a single movement of said hammer bank toward the first or second position after reversing direction at the second or the first position, respectively;

a sheet feeding mechanism for feeding the sheet of paper in the second direction during a hammer bank reversing time at which said hammer bank reverses direction at the first or second position, wherein said sheet feeding mechanism feeds the sheet of paper N-dot lines when the print cycle follows immediately thereafter; and control means for controlling said shuttle mechanism to prolong the hammer bank reversing time by slowing down said hammer bank to a second speed, said second speed being varied so as to effect revering of said hammer bank and allowing performance of a amount of line space feeding greater than N-dot lines within the prolonged hammer bank reversing time when the printing of one line is finished after carrying out a predetermined number of print cycles, said second speed being less than a speed of said hammer bank at which said hammer bank reverses when feeding N-dot lines or less.

2. A dot line printer according to claim 1, wherein said control means supplies a braking current to said motor to decelerate a rotational speed of said motor.

3. A dot line printer for carrying out printing on a sheet of paper upon making dot impressions thereon, comprising:

a hammer bank movably disposed along a line extending in a first direction and accommodating a plurality of print hammers divided into M groups, each group containing N-number print hammers spacedly arranged in the first direction and displaced on dot line from one another in a second direction perpendicular to the first direction, wherein M and N are integers;

a shuttle mechanism including at least a motor for shuttling said hammer bank back and forth, at a printing speed, along the line, said hammer bank reversing direction at first and second positions as said hammer bank shuttles, wherein N-dot lines are printed at a time during one print cycle of said hammer bank defined by a single movement of said hammer bank toward the first or second position after reversing speed, a shuttling period being defined by a movement of said hammer bank from said first position to said second position and back to said first position;

a sheet feeding mechanism for feeding the sheet of paper in the second direction during a hammer bank reversing time at which said hammer bank reverses direction at the first or second position, wherein said sheet feeding mechanism feeds the sheet of paper N-dot lines when the print cycle follows immediately thereafter; and first decision means for deciding whether an amount of line space feeding to be performed after the printing of one line is finished upon carrying out a predetermined number of print cycles is greater than a first predetermined amount, wherein the amount of lien spaced feeding is performed during a subsequent hammer bank shuttling period when said first decision means decides that the amount of line space feeding is greater than the first predetermined amount, said first decision means causes said shuttling period to elapse fully before subsequent printing operation occurs.

4. A dot line printer for carrying out printing on a sheet of paper upon making dot impressions thereon, comprising:

a hammer bank movably disposed along a line extending in a first direction and accommodating a plurality of print hammers divided into M groups, each group containing N-number print hammers spacedly arranged in the first direction and displaced one dot line from one another in a second direction perpendicular to the first direction, wherein M and N are integers;

a shuttle mechanism including at least a motor for shuttling said hammer bank back and forth, at a printing speed, along the line, said hammer bank reversing direction at first and second positions as said hammer bank shuttles, wherein N-dot lines are printed at a time during one print cycle of said hammer bank defined by a single movement of said hammer bank toward the first or second position after reversing direction at the second or the first position, respectively, said motor having a rotational speed;

a sheet feeding mechanism for feeding the sheet of paper in the second direction during a hammer bank reversing time at which said hammer bank reverses direction at the first or second position, wherein said sheet feeding mechanism feeds the sheet of paper N-dot lines when the print cycle follows immediately thereafter;

first decision means for deciding whether an amount of line space feeding to be performed after the printing of one line is finished upon carrying out a predetermined number of print cycles is greater than a first predetermined amount, wherein the amount of line space feeding is performed during a subsequent hammer bank shuttling operation when said first decision means decides that the amount of line space feeding is greater than the first predetermined amount; and second decision means for deciding whether the amount of line space feeding is greater than a second predetermined amount, said second predetermined amount being larger than said first predetermined amount, and control means for controlling said shuttle mechanism to prolong the hammer bank reversing time after the printing of one line is finished upon carrying out a predetermined number of print cycles if said first decision means decides that the amount of line space feeding is greater than said first predetermined amount and said second decision means decides that the amount of line space feeding is greater than said second predetermined amount, wherein the amount of line space feeding is performed within the prolonged hammer bank reversing time, a subsequent hammer bank movement, and another hammer bank reversing time following the subsequent hammer bank movement.

5. A dot line printer according to claim 4, wherein said control means supplies a braking current to said motor to decelerate said rotational speed of said motor.

* * * * *